US008136266B2

(12) United States Patent
McCarron

(10) Patent No.: US 8,136,266 B2
(45) **Date of Patent: *Mar. 20, 2012**

(54) ADVANCED TORQUE STABILITY FOOTBED

(75) Inventor: Michael P. McCarron, Danville, CA (US)

(73) Assignee: Ariat International, Inc., Union City, CA (US)

( * ) Notice: Subject to any disclaimer, the term of this patent is extended or adjusted under 35 U.S.C. 154(b) by 81 days.

This patent is subject to a terminal disclaimer.

(21) Appl. No.: 12/828,507

(22) Filed: Jul. 1, 2010

(65) Prior Publication Data

US 2011/0138655 A1 Jun. 16, 2011

Related U.S. Application Data

(63) Continuation of application No. 11/566,168, filed on Dec. 1, 2006, now Pat. No. 7,752,773.

(51) Int. Cl.
*A43B 13/38* (2006.01)

(52) U.S. Cl. ..... 36/44; 36/140

(58) Field of Classification Search ..... 36/43, 44, 36/140

See application file for complete search history.

(56) References Cited

U.S. PATENT DOCUMENTS

| | | | | |
|---|---|---|---|---|
| 5,067,255 | A | 11/1991 | Hutcheson | |
| 5,343,639 | A | 9/1994 | Kilgore et al. | |
| 5,695,850 | A | 12/1997 | Crow | |
| 5,994,245 | A | 11/1999 | Marier et al. | |
| 6,338,768 | B1 | 1/2002 | Chi | |
| 7,284,342 | B2 | 10/2007 | Avent et al. | |
| 7,360,325 | B2 | 4/2008 | Chen | |
| 7,752,773 | B2 * | 7/2010 | McCarron | 36/44 |
| 2003/0192202 | A1 | 10/2003 | Schoenborn et al. | |
| 2004/0016148 | A1 | 1/2004 | Chen | |
| 2005/0138844 | A1 | 6/2005 | Johnson | |
| 2006/0053657 | A1 | 3/2006 | Ailey et al. | |
| 2007/0084084 | A1 | 4/2007 | Rich | |
| 2007/0144038 | A1 | 6/2007 | Ailey et al. | |
| 2007/0175068 | A1 | 8/2007 | Lin | |
| 2007/0204484 | A1 | 9/2007 | Davis | |

FOREIGN PATENT DOCUMENTS

| | | | |
|---|---|---|---|
| DE | 3614064 | A1 | 10/1987 |
| WO | WO 2006/074528 | A1 | 7/2006 |

OTHER PUBLICATIONS

International Search Report and Written Opinion for International Application No. PCT/US2007/084866, mailed on May 2, 2008, 6 pages.

* cited by examiner

*Primary Examiner* — Marie Patterson

(74) *Attorney, Agent, or Firm* — DASCENZO Intellectual Property Law, P.C.

(57) ABSTRACT

The present invention provides a footbed made of cotton fabric, polyurethane, ethyl vinyl acetate, polyester and thermoplastic gel rubber. The invention also provides footwear which includes a footbed as described herein.

21 Claims, 3 Drawing Sheets

ADVANCED TORQUE STABILITY FOOTBED

RELATED APPLICATION

The present application is a continuation of and claims priority to U.S. patent application Ser. No. 11/566,168, which was filed on Dec. 1, 2006, and which is entitled "Advanced Torque Stability Footbed." The complete disclosure of the above-identified patent application is hereby incorporated by reference for all purposes.

BRIEF DESCRIPTION OF THE INVENTION

The present invention relates generally to a footbed for a shoe. More particularly, the present invention relates to a footbed with advanced torque stability.

BACKGROUND OF THE INVENTION

A shoe is generally comprised of an upper region connected to a sole. The sole is generally comprised of an outsole attached to a midsole. The upper region may be attached to the midsole. An insole may be disposed on top of the midsole in which case it is surrounded by the upper region. A footbed may be disposed within the shoe on top of the insole and therefore is next to the foot when the shoe is worn. Because the footbed is in direct contact with the foot, the footbed, if properly designed, may provide cushion, shock attenuation and rebound at appropriate stages of gait and also help the foot remain cool and comfortable. Such a footbed would have advanced torque stability over pre-existing footbeds.

In view of the foregoing, it would be desirable to have a footbed with the above properties.

SUMMARY OF THE INVENTION

The present invention satisfies these and other needs by providing a footbed which includes cotton fabric, polyurethane, ethyl vinyl acetate, polyester and thermoplastic gel rubber.

The invention also provides footwear which includes a footbed as described herein.

BRIEF DESCRIPTION OF THE DRAWINGS

For a better understanding of the nature and objects of the invention, reference should be made to the following detailed description taken in conjunction with the accompanying drawings, in which.

DETAILED DESCRIPTION OF THE INVENTION

Figure 1:
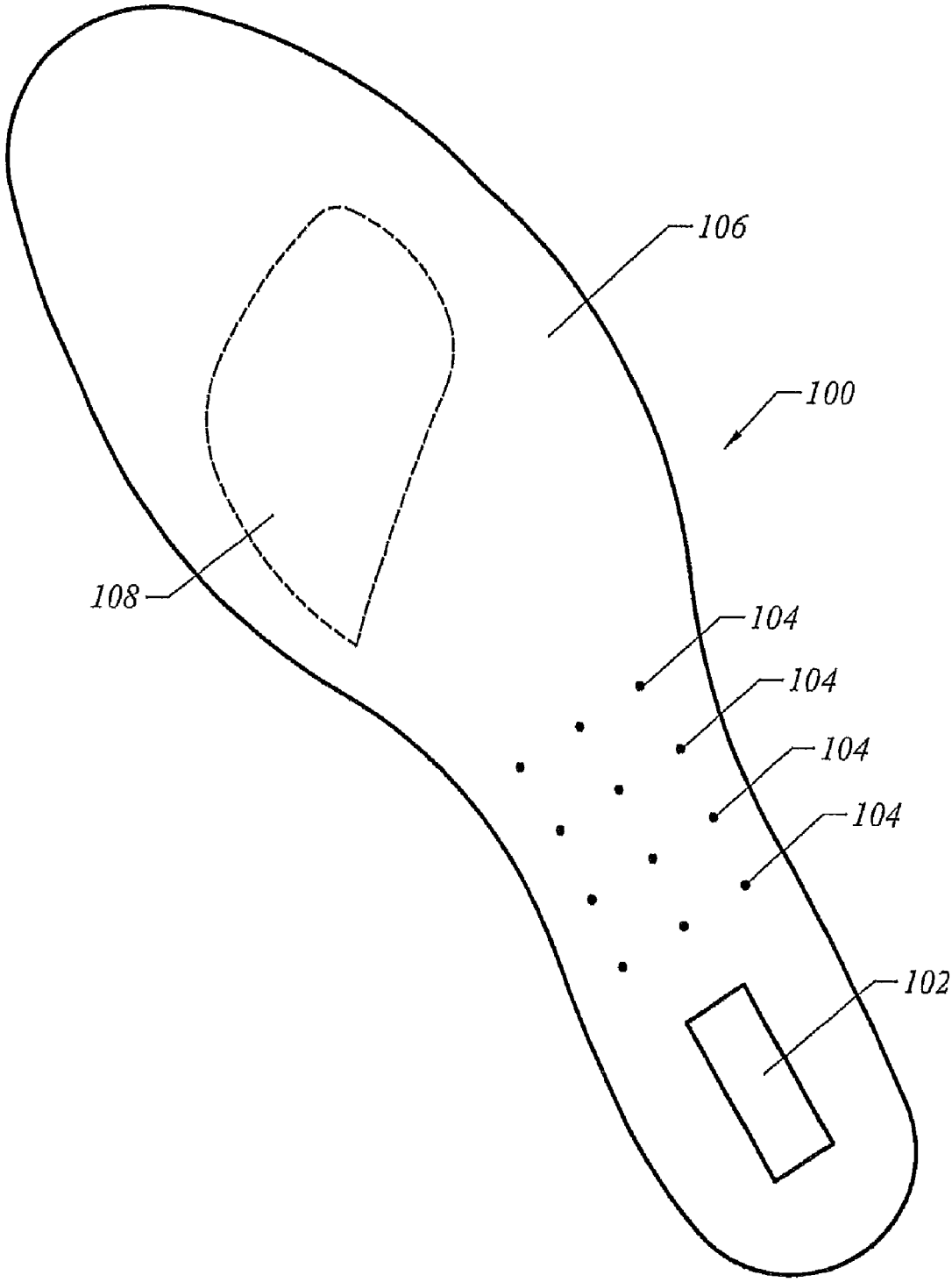
FIG. 1 illustrates the top of a footbed configured in accordance with an embodiment of the invention.
Figure 2:
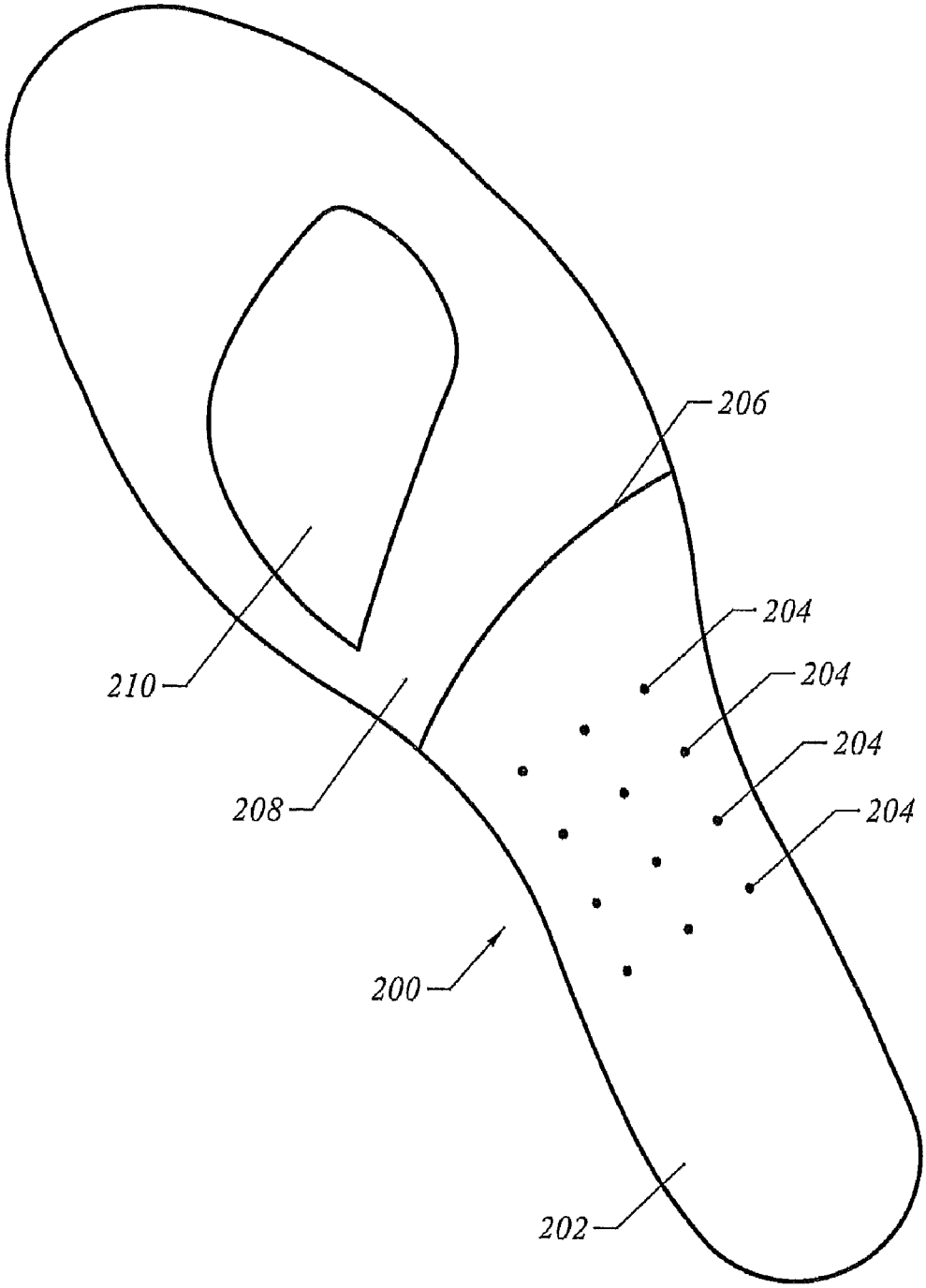
FIG. 2 illustrates the bottom of the footbed.

FIG. 1 illustrates the top of footbed 100. Logo 102 may be attached to cotton fabric 106. It should be noted that logo 102 serves only a decorative function and thus may be omitted without compromising any important functional properties of footbed 100. Punched perfs 104 are located on the shank region of footbed 100 and circulate airflow to cool the foot. Region 108 includes a pad of thermoplastic rubber gel (FIG. 2, infra). In some embodiments, the thickness of layer 106 is between about 0.6 mm and about 1.2 mm. In other embodiments, the thickness of layer 106 is between about 0.8 and about 1.0 mm.

FIG. 2 illustrates the bottom of footbed 200. The bottom of footbed 200 is made up of a number of materials which include polyester 202, ethyl vinyl acetate 208 and thermoplastic gel rubber 210. Punched perfs 204 are located on the shank region of footbed 200 and thus are localized in the portion of footbed 200 which includes polyester 202. Line 206 is where the heel cup region of footbed 200 which includes polyester 202 begins. Polyester 202 partially covers the layer 208 which includes ethyl vinyl acetate.

Ethyl vinyl acetate 208 provides cushion while walking. In some embodiments, the thickness of layer 208 is between about 1 mm and about 6 mm. In other embodiments, the thickness of layer 208 is between about 2 mm and about 5 mm. In still other embodiments, the hardness of layer 208 is between about 25 C and about 40 C. In still other embodiments, the hardness of layer 208 is between about 30 C and about 35 C. In still other embodiments, the thickness of layer 208 is between about 2 mm and about 5 mm and the hardness of layer 208 is between about 30 C and about 35 C. As used in the instant application, C is hardness determined by a durometer scale reading using the Asker C scale.

As illustrated in FIG. 2, a pad of thermoplastic rubber gel 210 is localized where it helps protect small bone and nerves in the metatarsal region of the foot by providing cushion, shock attenuation and rebound while walking. It should be noted that the pad of thermoplastic rubber gel extends from the bottom of footbed 200 to sit on top of ethyl vinyl acetate layer 208 in a recessed cavity.

In some embodiments, the thickness of the pad of thermoplastic rubber gel 210 is between about 2.5 mm and about 3.5 mm. In other embodiments, the thickness of the pad of thermoplastic rubber gel 210 is about 3 mm. In still other embodiments, the hardness of the pad of thermoplastic rubber gel 210 is between about 20 A and about 35 A. In still other embodiments, the hardness of the pad of thermoplastic rubber gel 210 is between about 25 A and about 30 A. In still other embodiments, the thickness of thermoplastic rubber gel 210 is about 3 mm and the hardness of the thermoplastic rubber gel 210 is between about 25 A and about 30 A. As used in the instant application, A is hardness determined by a durometer scale reading using the Shore A scale.

Polyester 202, as illustrated in FIG. 2, begins in the arch region of footbed 200 at 206 and forms a heel cup which increases torsional stability and helps to provide heel cuboid support while walking. In some embodiments, the thickness of layer 202 is between about 0.5 mm and about 1.5 mm. In other embodiments, the thickness of layer 202 is about 1 mm. In still other embodiments, the hardness of layer 202 is between about 90 A and about 100 A. In still other embodiments, the hardness of layer 202 is about 95 A. In still other embodiments, the thickness of layer 202 is about 1 mm and the hardness of polyester layer 202 is about 95 A.

Figure 3:
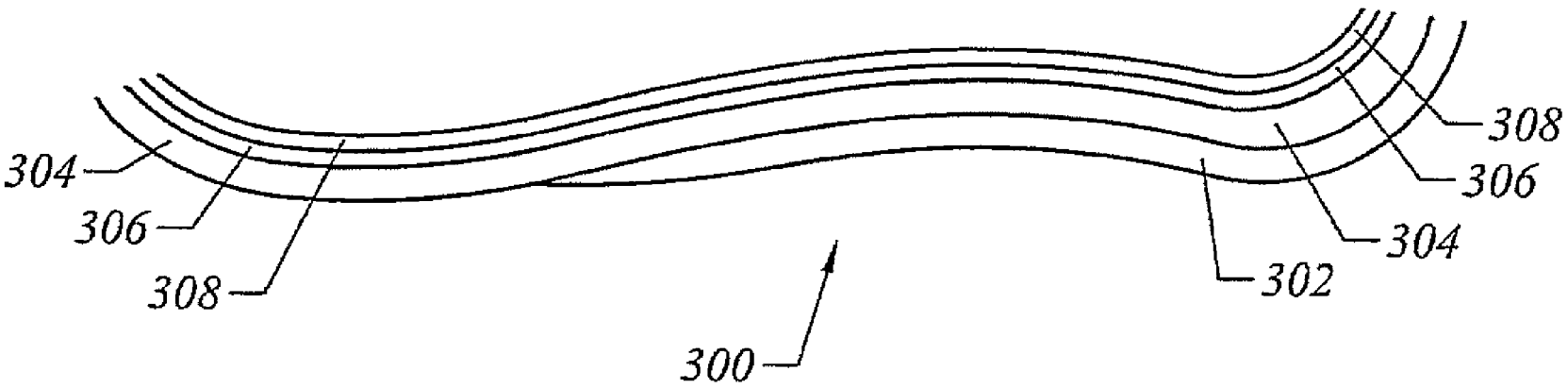
FIG. 3 is a side view of the footbed shown in cross section.

Referring now to FIG. 3, footbed 300, shown in cross-section has three layers (304, 306 and 308) in the forefoot (pad of thermoplastic rubber gel not shown) and four layers (302, 304, 306 and 308) in the heel region. Layer 304 includes ethyl vinyl acetate as described, supra, while layer 308 includes cotton fabric as described, supra. In the heel region, layer 302 includes polyester, as described, supra, covers layer 304.

Layer 306 which is between layer 304 and layer 308 includes polyurethane. In some embodiments, the polyurethane is poly A+B. Polyurethane provides comfort, shock attenuation and reduces compression. In addition, polyurethane aids in air circulation and hence cooling and is both a bactericide and a fungicide.

In some embodiments, the thickness of layer 306 is between about 0.5 mm and about 7.5 mm. In other embodiments, the thickness of layer 306 is between about 1.5 mm and about 6.5 mm. In still other embodiments, the hardness of layer 306 is between about 15 C and about 30 C. In still other embodiments, the hardness of layer 306 is between about 20 C and about 25 C. In still other embodiments, the thickness of layer 306 is about 3 mm and the hardness of layer 306 is between about 20 C and about 25 C. In still other embodiments, the polyurethane is poly A+B, the thickness of layer 306 is between about 1.5 mm and about 6.5 mm and the hardness of layer 306 is between about 20 C and about 25 C.

In some embodiments, the thickness of the ethyl vinyl acetate layer is between about 2 mm and about 5 mm, the hardness of the ethyl vinyl acetate layer is between about 30 C and about 35 C, the thickness of the polyester layer is about 1 mm, the hardness of the polyester layer is about 95 A, the thickness of the thermoplastic gel rubber layer is about 3 mm and the hardness of the thermoplastic gel rubber layer is between about 25 A and about 30 A. In other embodiments, the thickness of the ethyl vinyl acetate layer is between about 2 mm and about 5 mm, the hardness of the ethyl vinyl acetate layer is between about 30 C and about 35 C, the thickness of the polyester layer is about 1 mm, the hardness of the polyester layer is about 95 A, the thickness of the thermoplastic gel rubber layer is about 3 mm, the hardness of the thermoplastic gel rubber layer is between about 25 A and about 30 A, the thickness of the polyurethane layer is between about 1.5 mm and about 6.5 mm and the hardness of the polyurethane layer is between about 20 A and about 25 A. In still other embodiments, the thickness of the ethyl vinyl acetate layer is between about 2 mm and about 5 mm, the hardness of the ethyl vinyl acetate layer is between about 30 C and about 35 C, the thickness of the polyester layer is about 1 mm, the hardness of the polyester layer is about 95 A, the thickness of the thermoplastic gel rubber layer is between about 1.5 mm and about 6.5 mm, the hardness of the thermoplastic gel rubber layer is between about 25 A and about 30 A, the polyurethane is poly A+B, the thickness of the polyurethane layer is about 3 mm and the hardness of the polyurethane layer is between about 20 A and about 25 A.

The footbed described herein can be made by various processes which include, but are not limited to the following method. The cotton fabric, polyurethane layer, preferably, a poly A+B layer and ethyl vinyl acetate layer are co-molded by a cold press process. The logo is then attached and the perfs are punched into the shank region of the footbed. Finally, a die cut thermoplastic rubber gel pad is stitched into the forefoot region of the footbed.

Also provided herein is footwear which consists of at least one shoe and a footbed as described, supra. The footbed may be inserted into the shoe prior to use.

While the present invention has been described with reference to the specific embodiments thereof, it should be understood by those skilled in the art that various changes may be made and equivalents may be substituted without departing from the true spirit and scope of the invention as defined by the appended claims. In addition, many modifications may be made to adapt a particular situation, material, composition of matter, method, process step or steps, to the objective, spirit and scope of the present invention. For example, latex could replace ethyl vinyl acetate in the footbed described herein. All such modifications are intended to be within the scope of the claims appended hereto.

The invention claimed is:

1. A footbed, comprising:

a layered footbed body comprising at least a forefoot region and a heel region, wherein the forefoot region and the heel region each comprise a plurality of layers, with the plurality of layers comprising:

a surface layer positioned for contact with a bottom surface of a user's foot when an article of footwear containing the footbed is worn on the user's foot;

a layer of ethyl vinyl acetate positioned beneath the surface layer and configured to provide cushioning to the user's foot when an article of footwear containing the footbed is worn on the user's foot;

a layer of polyurethane configured to provide shock attenuation and compression resistance when an article of footwear containing the footbed is worn on the user's foot; and a pad of thermoplastic rubber gel positioned to provide cushioning and rebound to a metatarsal region of the user's foot when an article of footwear containing the footbed is worn on the user's foot; and wherein the heel region further comprises a heel cup shaped to provide torsional stability and cuboid support to the user's foot when an article of footwear containing the footbed is worn on the user's foot.

2. The footbed of claim 1, wherein the layer of polyurethane at least partially covers the layer of ethyl vinyl acetate.

3. The footbed of claim 1, wherein the layer of polyurethane is coextensive with the layer of ethyl vinyl acetate.

4. The footbed of claim 1, wherein the layer of polyurethane is in contact with the layer of ethyl vinyl acetate.

5. The footbed of claim 1, wherein the surface layer is a fabric layer.

6. The footbed of claim 5, wherein the surface layer is formed from cotton.

7. The footbed of claim 1, wherein the layer of polyurethane and the layer of ethyl vinyl acetate each include a cavity into which the pad extends.

8. The footbed of claim 1, further comprised of punched perfs extending through the plurality of layers.

9. The footbed of claim 8, wherein the footbed body includes a shank region between the forefoot region and the heel region, and further wherein the punched perfs are in the shank region of the footbed.

10. The footbed of claim 1, wherein the layer of polyurethane has a thickness between about 0.5 mm and about 7.5 mm.

11. The footbed of claim 1, wherein the layer of polyurethane has a hardness of 15-30 C on the Asker C scale.

12. The footbed of claim 1, wherein the layer of ethyl vinyl acetate has a thickness of between about 1 mm and about 6 mm.

13. The footbed of claim 1, wherein the layer of ethyl vinyl acetate has a hardness of 25-40 C on the Asker C scale.

14. The footbed of claim 1, wherein the surface layer has a thickness of between about 0.6 mm and about 1.2 mm.

15. The footbed of claim 1, wherein the pad of thermoplastic gel has a thickness of between about 2.5 mm and about 3.5 mm.

16. The footbed of claim 1, wherein the pad of thermoplastic gel has a hardness of 15-30 C on the Asker C scale.

17. The footbed of claim 1, wherein the heel cup extends beneath the plurality of layers.

18. The footbed of claim 1, wherein the heel cup has a thickness of about 0.5 mm and about 1.5 mm.

19. The footbed of claim 1, wherein the heel cup has a hardness of 90-100 A on the Shore A scale.

20. The footbed of claim 1, wherein the plurality of layers are co-molded layers.

21. An article of footwear comprising the footbed of claim 1.

* * * * *